US011117147B2

(12) United States Patent
Knight et al.

(10) Patent No.: US 11,117,147 B2
(45) Date of Patent: Sep. 14, 2021

(54) PUMP DISPENSERS

(71) Applicant: Rieke Packaging Systems Limited, Leicester (GB)

(72) Inventors: Simon Christopher Knight, Bridgend (GB); David John Pritchett, Ashby de la Zouch (GB); Thomas P. Kasting, Fort Wayne, IN (US); Mark Edward Box, Pathlow (GB); Raymond Yu, Northfield (GB)

(73) Assignee: RIEKE PACKAGING SYSTEMS LIMITED

( * ) Notice: Subject to any disclaimer, the term of this patent is extended or adjusted under 35 U.S.C. 154(b) by 0 days.

(21) Appl. No.: 16/672,857

(22) Filed: Nov. 4, 2019

(65) Prior Publication Data

US 2020/0061649 A1 Feb. 27, 2020

Related U.S. Application Data

(63) Continuation of application No. 15/484,205, filed on Apr. 11, 2017, now Pat. No. 10,464,088, which is a (Continued)

(51) Int. Cl.
*B05B 11/00* (2006.01)
*B05B 15/20* (2018.01)
*B05B 15/25* (2018.01)

(52) U.S. Cl.
CPC .. *B05B 11/00418* (2018.08); *B05B 11/00416* (2018.08); *B05B 11/3025* (2013.01); (Continued)

(58) Field of Classification Search
CPC ..... B05B 11/00416; B05B 11/00418; B05B 11/3025; B05B 11/3059; B05B 11/3061; B05B 11/3067; B05B 15/20; B05B 15/25
See application file for complete search history.

(56) References Cited

U.S. PATENT DOCUMENTS 3,724,726 A 4/1973 Susuki
4,485,943 A * 12/1984 Czech ..... B05B 11/00416 222/256

(Continued)

FOREIGN PATENT DOCUMENTS

FR 2668082 4/1992

OTHER PUBLICATIONS

International Bureau of WIPO, International Preliminary Report on Patentability, PCT/EP2015/074265, dated Apr. 25, 2017.

*Primary Examiner* — Vishal Pancholi
*Assistant Examiner* — Bob Zadeh
(74) *Attorney, Agent, or Firm* — McDonald Hopkins LLC

(57) ABSTRACT

A dispenser for dispensing a flowable product from a container has a pump module mounted on the container at an opening thereof. The pump module includes a pump body, which defines a pump chamber and a pump chamber inlet for product to flow from the container interior into the pump chamber. A pump actuator is operable in a pumping stroke relative to the pump body to vary the volume of the pump chamber and dispense the product. The pump includes a movable body portion which is operable in a displacement stroke into the container. The movable portion has a displacement body with a product-engaging face directed onto an interior product space of the container upstream of the pump chamber inlet, to assist priming. Below this a disrupter member, a grid of narrow bars, projects to penetrate the product.

22 Claims, 9 Drawing Sheets

Related U.S. Application Data continuation of application No. PCT/EP2015/074265, filed on Oct. 20, 2015.

(60) Provisional application No. 62/065,971, filed on Oct. 20, 2014.

(52) U.S. Cl.
CPC ..... *B05B 11/3059* (2013.01); *B05B 11/3061* (2013.01); *B05B 11/3067* (2013.01); *B05B 15/20* (2018.02); *B05B 15/25* (2018.02)

(56) References Cited

U.S. PATENT DOCUMENTS 4,817,829 A * 4/1989 Fuchs ..... B05B 11/3061 222/259
4,949,876 A 8/1990 Schneider
5,363,993 A 11/1994 Mascitelli
5,449,094 A * 9/1995 Behar ..... B05B 11/0013 222/321.3
5,518,377 A 5/1996 Bougamont
5,548,943 A 8/1996 Behar
6,013,270 A 1/2000 Hargraves
6,021,924 A * 2/2000 Suck ..... B05B 11/3023 222/105
6,170,713 B1 1/2001 Schultz
7,281,644 B2 10/2007 Cater
2002/0003151 A1 1/2002 Beranger
2002/0185503 A1 12/2002 Beranger
2005/0023302 A1 2/2005 Cater
2005/0279774 A1 12/2005 Kuwahara
2006/0086760 A1 * 4/2006 Cohen ..... B05B 11/305 222/321.9
2008/0164344 A1 7/2008 Lompech
2008/0296319 A1 12/2008 Bockmann
2010/0252582 A1 10/2010 Montaner
2011/0240677 A1 10/2011 Dwyer
2013/0228482 A1 9/2013 Son
2015/0335528 A1 11/2015 Kim
2017/0216862 A1 8/2017 Knight

* cited by examiner

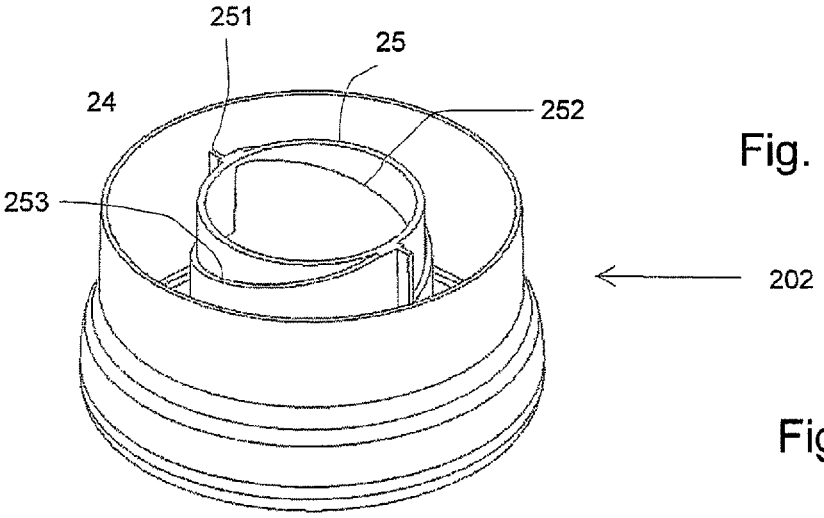
Fig. 4(a)
Fig. 4(b)
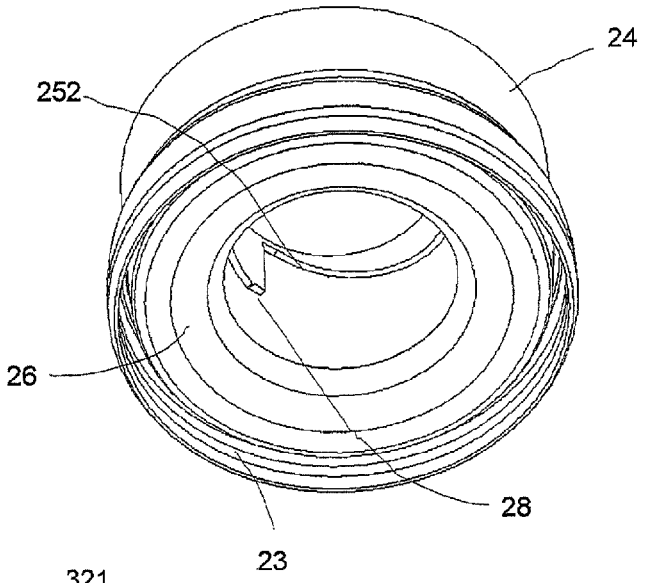
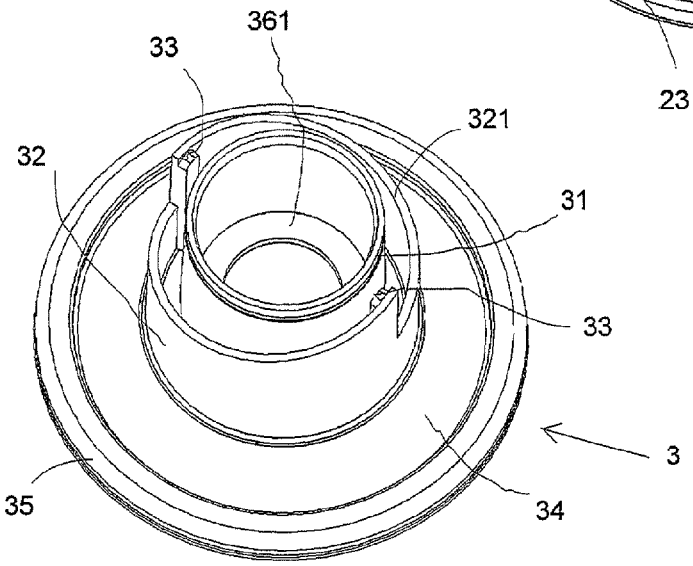
Fig. 5

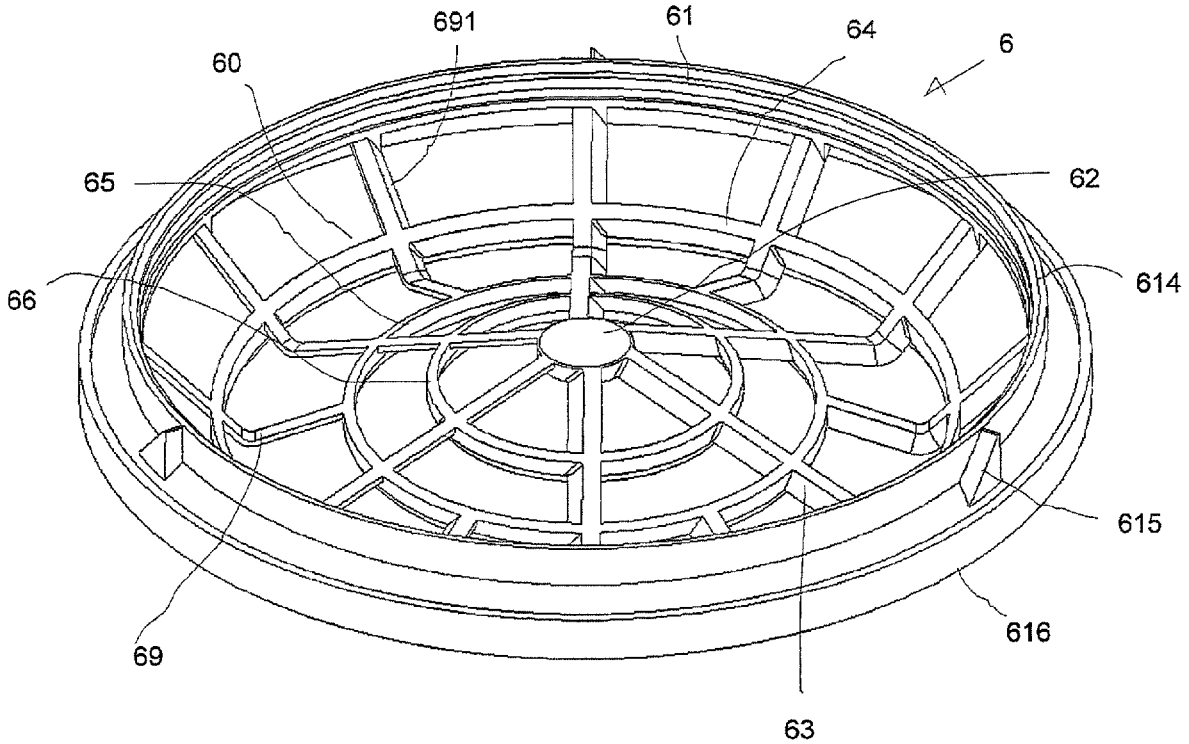
Fig. 6
Fig. 7(a)
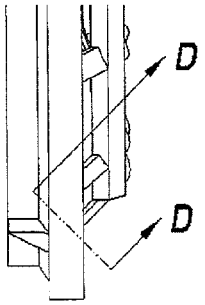
Fig. 7(b)
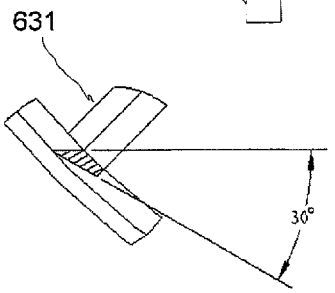
SECTION D-D
SCALE 4

PUMP DISPENSERS

CROSS REFERENCE TO RELATED APPLICATIONS

This application is a continuation of U.S. patent application Ser. No. 15/484,205 filed on Apr. 11, 2017 and now granted as U.S. Pat. No. 10,464,088, which was a continuation of PCT/EP2015/074265 filed Oct. 20, 2015, which claimed the benefit of U.S. Provisional Application No. 62/065,971 filed Oct. 20, 2014. All of the foregoing applications are hereby incorporated by reference.

FIELD OF THE INVENTION

This invention relates to dispensers for use in dispensing flowable products, and to methods of use thereof. The present proposals are particularly but not exclusively concerned with dispensers adapted for use with flowable products that are difficult or even impossible to dispense using conventional dispenser pumps, because they resist flow.

BACKGROUND OF THE INVENTION

Pump dispensers having a pump mounted on a container are widely used for dispensing fluid products (liquids, creams, pastes) such as medicaments, bathroom products and cosmetics. Generally, a dispenser comprises a container for the product and a pump module mounted on the container at an opening thereof. The pump module comprises a pump body defining or incorporating a pump chamber, with a pump chamber inlet for the flow of product from the container into the pump chamber through an inlet valve. A pump actuator such as a reciprocable plunger is operable in a pumping stroke relative to the pump body to vary the volume of the pump chamber for dispensing the product through a discharge channel, often via an outlet valve, on depression of the plunger and for re-filling of the pump chamber through the inlet valve as the plunger rises, usually driven by a restoring spring. Often the plunger carries a piston which operates in a cylinder of the pump body, but alternatives exist.

Conventionally the container is upright with the pump on top, the actuating member such as a plunger projecting upwardly. So, for convenience the expressions "top", "upper" etc. are used herein to refer to the conventionally-corresponding directions and positions (i.e. the extending directions of a plunger, the direction towards the pump rather than towards the closed end of the container space) and "bottom", "downwards" etc. analogously refer to the opposite direction/position. Usually this is in fact the orientation, and is preferred herein, but should not be regarded as strictly limiting.

Certain of the present proposals are especially relevant for dispensers of the "airless" type in which the internal product chamber volume of the container reduces as product is dispensed, so that remaining product is not exposed to air. Such dispensers use containers with a follower piston which moves up the container behind the mass of product as its volume progressively decreases, collapsible containers or collapsible container liners. They are used when the fluid product is sensitive to oxidation or to airborne contamination, or should be kept clean for any other reason. These dispensers generally do not use a dip tube extending down into the product from the pump inlet; product enters the pump inlet directly from the container interior space.

Some flowable materials are hard to pump because they do not flow readily. These include certain greases, ointments and other "fluids" that are not naturally self-levelling. One frequent characteristic feature of these products is their plastic nature, exhibiting a definite yield stress. Under low or zero shear they retain their shape and do not flow or level at all. These properties are desirable e.g. for ointments which should not flow away from an application site. However they cause problems in the operation of pumps which rely on modest suction (usually from a pump spring) to fill (prime) the pump chamber through the inlet. The problems are exacerbated by the impossibility of filling the containers always to exactly the same level. When a product is already difficult to prime, a slight drop in level below the inlet can make it impossible. Accordingly, there is a range of products which is not supplied in pump dispensers but instead packaged in tubs from which the lid must be removed and the product taken out with fingers or a spatula. This is messy, tends to contaminate the tub contents and there is no uniform dosing. It would be much better to dispense a controlled, meter dose as with a pump.

The state of the art includes proposals for pump dispensers of the airless type such as EP-A-1015341, EP-A-2153908, EP-A-2095882, EP-A-2353727 and EP-A-1629900 in which the bottom of the pump module dips into the top of the product, displacing product upwardly to fill the pump chamber and/or to displace air out from the package before sealing. However, these dispenser types may not be effective with very thick products.

In the present invention we provide several proposals for new features of pump dispensers which can improve their performance with thick, viscous, pasty or waxy products. In embodiments, our proposals are for use with products which have scarcely been pumped successfully before, such as ointments displaying a yield stress or shear-thinning/pseudoplastic properties, which typically are based on a mix of solid and liquid hydrocarbons including microcrystalline waxes for structuring. Also, for general flowable materials showing a viscosity of 30, 40 or even 50 Pa·s or more at room temperature and pressure. However, the new proposals also offer conveniences with less demanding products, as will be understood from the description which follows.

SUMMARY OF THE INVENTION

Various aspects of our new proposals are now described.

(1) Priming

In this aspect the invention provides a dispenser comprising a container for flowable product and a pump module mounted on the container at an opening thereof, the pump module comprising a pump body, which defines a pump chamber and a pump chamber inlet for product to flow from the container interior into the pump chamber, and a pump actuator operable in a pumping stroke relative to the pump body to vary the volume of the pump chamber and dispense the product through a pump chamber outlet and a discharge channel of the pump module;

the pump body comprising a movable portion which is operable in a displacement stroke into the container, the movable portion comprising a displacement body having a product-engaging face directed onto an interior product space of the container upstream of the pump chamber inlet. In use the movement of the displacement body into the container in the displacement stroke displaces product in the interior product space towards and/or into the pump chamber inlet.

Desirably the pump body comprises a fixed body portion which is fixed relative to the container, e.g. around an opening edge thereof, and the movable portion is operable in the displacement stroke into the container relative to the fixed body portion.

This proposal has special value in promoting or initiating the priming (filling of the pump chamber through its inlet) of pumps in dispensers for thick liquids, pastes, creams, ointments and the like. The displacement stroke, being a movement into the container, can be driven directly by the user, e.g. by a push or turn, giving much more force and pressure for shearing the product than is available from a typical pump plunger return spring. Taking into account also that the first disturbance of the product body in an unused pack is often the most difficult for priming—it may have partially set, hardened or skinned at its surface—the present proposal may offer the convenience of pump-type dispensing for products which have not previously been available in such packs.

Preferred features of the displacement body include the following, any or all of which may be combined in preferred embodiments of the proposal:

- a periphery which reaches the container wall, and preferably makes a sealing contact against it at a peripheral seal, the seal desirably having a sharp downward edge to wipe the container wall—this inhibits or prevents escape of product around the displacement body which can therefore sweep a space piston-wise and not merely displace its own volume, and may therefore be in plate form;
- a gradual slope of the product-engaging face in the direction towards the pump (upward) from the periphery to the inlet (usually at the center), desirably uninterrupted by any non-sloping or oppositely-sloping face feature—typically a generally conical or frusto-conical form—the slope may have a steeper region adjacent the container wall and/or adjacent the inlet;
- a generally annular or disk form, and desirably a one-piece component presenting all of the closed product-engaging face (except that optionally a peripheral seal thereof may be discrete);
- a disrupter formation projecting in front of the product-engaging face into the interior product space, desirably comprising a plurality of bars with multiple flow openings between for product flow, and either formed integrally with or attached in front of the product-engaging face, the bars most preferably being combined as components of a disrupter unit, defining the multiple flow openings, which may attach e.g. at the periphery of the product-engaging face, and may itself be a one-piece component: a disrupter may improve movement of certain product types relative to the displacement body during the displacement stroke and/or in flow towards the inlet after a dispensing stroke [further optional and preferred features of such a disrupter in this context are as described below in aspects (2) and (3)].

The pump chamber inlet is usually central, and the displacement body then has a central opening which is the pump chamber inlet or communicates with the pump chamber inlet.

Where the pump is a piston-cylinder pump in which a piston and cylinder define the pump chamber, the movable portion of the pump body may comprise the cylinder, desirably in one piece with the displacement body.

Typically the dispenser will include a displacement actuating mechanism for controllably driving the movable body portion in the displacement stroke relative to e.g. a fixed body portion, and driven itself by manual force applied by a user to an exterior actuator of the actuating mechanism.

Preferably the actuating mechanism moves the movable portion with a combination of advancement into the container and rotation around the axis of advancement, because this may ease movement against the product mass as the displacement body advances, and promote initial displacement of the product. In particular it may also enhance the disrupting effect of any disrupter formation(s) on the displacement body. The actuating mechanism may include one or more guide tracks, e.g. helical, to guide such relative movement between driving and driven components of the mechanism and/or between the movable body and fixed body.

In preferred embodiments the pump actuator of the dispenser is a plunger reciprocable relative to the pump body. The plunger usually has an exterior actuating head to be pressed by the user for dispensing and a stem connecting to the mechanism in the pump for varying pump chamber volume, the plunger being reciprocable in the axial direction of the stem. Usually this mechanism is a piston co-operating with a cylinder, one being on the plunger stem and the other defined in the body. The piston on the plunger stem is preferred. The pump preferably includes a return spring urging the plunger out to its extended position. We prefer to use such a reciprocable plunger or at least the actuating head thereof also as the actuator for the actuating mechanism of the present proposal.

Thus in such embodiments the plunger may have a drive engagement formation which engages a corresponding driven engagement formation of the movable body. The drive engagement formation of the plunger is desirably not on the stem thereof but radially outwardly of the stem, e.g. on a drive wall extending downwardly from the head, and which may be a circular wall (skirt) or wall segment(s) concentric with the stem.

Any one or more of the following components: (i) the displacement actuator (e.g. a plunger's drive engagement formation), (ii) a driven engagement formation (such as a guided part of the movable body, e.g. on or adjacent a pump cylinder) and (iii) a fixed body part relative to which one of the former must move axially in contact (such as a guide formation (e.g. sleeve) of the fixed body) desirably has a guide track and especially a helical or otherwise inclined (relative to axial) track or cam formation which engages a corresponding follower formation on one of the other mentioned components, so that an axial push on the displacement actuator is converted to a rotation of the displacement body.

A said fixed body portion may comprise a peripheral securing formation, such as a threaded or snap skirt or ring—any conventional securement may be used—for fixing onto the container edge around its opening, to establish a fixed position relative to the container. The fixed body may also comprise one or more guide portions, preferably a central or concentric guide portion, such an upright sleeve or tube, which slidably engages one or more corresponding guided portions of the movable body, such as a pump cylinder component comprised therein, to guide the movable body in the displacement stroke by maintaining its alignment with the fixed body portion.

Alternatively the movable body may have its own actuator portion separate from any pump plunger, e.g. a discrete external sleeve or flange which can be used to push the movable portion and displacement body down into the container without involving elements of the pump mechanism itself.

In any of these displacement actuating mechanisms it is preferred to have any or all of:

- an initiation stop mechanism preventing initiation of the displacement actuation until a preliminary release movement is made or retaining component shifted or removed;
- an end stop mechanism to halt the movement of the movable body at a predetermined point (degree of insertion into the container) to finish the displacement stroke;
- a retaining catch to hold the movable body against return after the displacement stroke.

A related aspect in aspect (1) is a method of using a dispenser of any kind described herein, and filled with a product of any kind proposed herein, the method including driving the movable body down thereby driving the product-engaging face of the displacement body into contact with the product, displacing product in the interior product space towards and/or into the pump chamber inlet. The various preferred and optional apparatus features described above operate correspondingly in the preferred methods.

(2) Dividing and Shearing Flowing Product

In this aspect the invention provides a dispenser comprising a container for flowable product and a pump module mounted on the container at an opening thereof, the pump module comprising a pump body, which defines a pump chamber and a pump chamber inlet for product to flow from the container interior into the pump chamber, and a pump actuator operable in a pumping stroke relative to the pump body to vary the volume of the pump chamber and dispense the product through a pump chamber outlet and a discharge channel of the pump module;

the pump body comprising, upstream of the pump chamber inlet and separating the pump chamber inlet from at least most and preferably substantially all of the container interior, a dividing screen structure comprising a plurality of dividing bars defining multiple flow openings through which product passes on the way to the pump chamber inlet from the container interior.

Preferably there are at least 15, more preferably at least 20, more preferably at least 30 flow openings in the structure. Preferably the flow openings account for at least 60%, more preferably at least 70%, more preferably at least 80% of the cross-sectional area of the dividing screen structure inside the closed periphery.

Desirably the dividing bars between the flow openings are thicker in the dimension extending away from the pump and into the container (typically, downward) than they are in the transverse dimension. Desirably they have convergent and/or sharp cutting edges directed away from the pump, i.e. towards the product approaching the pump inlet.

Suitable dispositions of the dividing bars and flow openings include those described below in aspect (3). It may be a grid or mesh, preferably substantially rigid in use. The structure may be planar, domed, or otherwise shaped e.g. as described in (3) below. Desirably a set of concentric annular or part-annular bars is joined by circumferentially-distributed radial bars. The structure may span the container interior or it may be localised around the inlet.

Preferably the dividing screen structure is a unit, desirably a one-piece unit, attached to the underside or base of the pump, or especially to that face of the pump body directed onto the product in the container interior, e.g. attached at or around the periphery of the product-engaging face of the pump body such as of a displacement unit as in aspect (1) above. It may have a continuous peripheral annulus.

The effect of a dividing screen structure is to cut and divide the flow of product as it approaches the inlet during initial priming, or during re-filling of the pump chamber in operation (often under the influence of a return spring). With certain products (shear-thinning products, often with marked plasticity) the application of shear markedly improves flowability by reducing viscosity. The oncoming mass of product undergoes shear wherever it is "cut" by a divider bar. This improves shear and flow at least near to the bars, improving movement of divided parts of the mass relative to other parts, and so reducing overall the force needed to bring a stream of product into the pump chamber inlet. Accordingly a pump spring is better able to draw the product into the inlet.

A related aspect in aspect (2) is a method of using a dispenser of any kind described herein, and filled with a product of any kind proposed herein, the method including causing the product to flow through the dividing screen towards the inlet during priming, or refilling of the pump chamber before or after dispensing, thereby cutting and dividing the flow of product. The various preferred and optional apparatus features described above operate correspondingly in the preferred methods.

(3) Disrupting Product

In this aspect the invention provides a dispenser comprising a container for flowable product and a pump module mounted on the container at an opening thereof, the pump module comprising a pump body, which defines a pump chamber and a pump chamber inlet for product to flow from the container interior into the pump chamber, and a pump actuator operable in a pumping stroke relative to the pump body to vary the volume of the pump chamber and dispense the product through a pump chamber outlet and a discharge channel of the pump module;

the pump body comprising a product-engagement portion directed onto an interior product space of the container, upstream of the pump chamber inlet, and a disrupter formation which projects in front of the product-engaging portion into the interior product space, the disrupter formation comprising an array of disrupter elements with spacing between for product to flow between them towards the pump inlet.

The effect of the disrupter formation is to disrupt the product near to the pump chamber inlet and help to bring it into a more flowable state, or to help keep it in a more flowable state.

At the simplest, it may be a fixed structure on the pump body. It can disrupt the product in the container on assembly of the pump module onto the filled container, and/or subsequently during movement of the product in the dispenser. Preferably however the disrupter formation is mounted movably relative to a fixed body portion of the pump body and an actuator mechanism is provided for moving it in contact with the product in the container interior after the pump module has been assembled onto the filled container e.g. at the time of initiation or first priming, or as a preliminary to subsequent use of the dispenser.

The relative movement may be axial and/or rotational relative to the fixed body. Thus the pump body may comprise a movable portion which is operable in a disrupting stroke, the movable portion comprising or carrying the product-engagement portion. The pump body can comprise a fixed body portion which is fixed relative to the container, e.g. around an opening edge thereof, and the movable portion is operable in the disrupting stroke relative to the fixed portion.

Actuating mechanism for the disrupting stroke may have any of the same features as described above in relation to the actuating mechanism for aspect (1), except that in the present aspect advancement of the formation into the container interior is optional. Movement of the disrupting formation relative to the product may be e.g. only rotational. However it is preferred to combine advancement and rotation, and most preferred to combine the features of both aspects (1) and (3), with the displacement stroke of (1) corresponding to the disrupting stroke of (3), aspect (2) also being a combinable option.

In form, the disrupter formation may have any of the features already put forward for the disrupter formation option in aspect (1) and the dividing screen structure of aspect (2). That is to say, a disrupter formation may project in front of a product-engaging face of the pump body, into the interior product space, desirably comprising a plurality of bars with multiple flow openings between for product flow, or prongs or other agitator projections, and either formed integrally with or attached in front of the product-engaging face, the bars most preferably being combined as components of a disrupter unit, defining the multiple flow openings, or carrying such prongs or projections, and which may attach e.g. at the periphery of the product-engaging face, and may itself be a one-piece component.

Additionally or alternatively, for dynamic disruption it is desirable that the elements (bars, prongs, spokes etc.) of the formation pass readily into the product and especially in the case of advancement into a very thick, hard or flow-resistant product. It is therefore preferred that such elongate elements of the formation as extend transversely to the direction of their movement in the disrupting stroke have sides which are leading in relation to that movement, and these leading sides are formed as convergent or sharp edges. Additionally or alternatively it is preferred that these elongate elements are narrower in the dimension transverse to that direction of movement than in the direction of movement. These measures help the elements to cut into and pass through thick product to cause or start disruption. Thus, in a preferred version in which the disrupter formation comprises a set of circumferentially-distributed radially-extending bars (spokes, optionally connecting between concentric annular or part-annular bars, e.g. 1 to 5 of the latter between the periphery and center), and the disruption stroke includes rotation, the spokes may have cutting edges directed with a corresponding circumferential component. An axial component of cutting direction may be present when the disruption stroke includes advancement, so when both rotation and advancement are involved the spokes may have cutting edges directed obliquely to the circumferential and axial directions.

When the disruption stroke includes advancement the disrupter formation may also have an overall shape envelope with one or more local leading formations (points or edges) so that not all the elements of the formation enter the product together. This helps to reduce stress on the components and makes the disruption more progressive and reliable. In the case of a circular formation with spokes and a concentric rings we prefer a structure in which a concentric ring of intermediate diameter, i.e. between the center and the periphery, forms a downwardly-projecting circular edge—typically with corresponding inclination of the neighbouring spokes out of the radial plane—which is the or a lowermost part of the structure which will enter the product before the neighbouring regions, or first of all, on advancement.

As in the aspect (1), in preferred embodiments of aspect (3) the pump actuator of the dispenser is a plunger reciprocable relative to the pump body. The plunger usually has an exterior actuating head to be pressed by the user for dispensing and a stem connecting to the mechanism in the pump for varying pump chamber volume, the plunger being reciprocable in the axial direction of the stem. Usually this mechanism is a piston co-operating with a cylinder, one being on the plunger stem and the other defined in the body. The piston on the plunger stem is preferred. The pump preferably includes a return spring urging the plunger out to its extended position. We prefer to use such a reciprocable plunger or at least the actuating head thereof also as the actuator for an actuating mechanism of the disruption stroke in the present proposal.

Where an actuating head of a pump plunger is to be used for actuation with rotation and is itself to rotate in actuation, it is desirably formed with gripping formations to help. Often and preferably there will be a radially-projecting spout which can be gripped. Additionally or alternatively a casing or shroud component of the head can be formed with a circumferential series of indentations or projections presenting respective circumferentially-directed engagement surfaces. One option is to make the indentations or projections asymmetric, presenting steeper surfaces facing one circumferential direction than in the other, corresponding to the direction of intended (and more difficult) rotation for actuating displacement and/or disruption.

A related aspect in aspect (3) is a method of using a dispenser of any kind described herein, and filled with a product of any kind proposed herein, the method including moving the disrupter formation in or into the product, e.g. driving a said movable body down and/or round, to disrupt the product. The various preferred and optional apparatus features described above operate correspondingly in the preferred methods.

4) Inlet Valve

Generally pump inlets have an inlet valve. The nature of the inlet valve is not generally critical. However for thick products a swinging flap valve is not preferred because it may not close properly. A flap/flat valve with spring closing bias may offer rather high flow resistance to thick products, as does a ball valve. We prefer a poppet valve whose closure element—desirably a flat plate—moves directly up and down off the seat (around the inlet opening of the pump body) without closing bias other than gravity. A retention structure limits the rise of the closure element off the seat. Preferably the retention structure is fixed, e.g. in one piece, to the closure element. The retention structure may comprise plural claw elements, each with a downward shank extending through the inlet hole and an outward claw.

Additionally in a fourth aspect herein we have new proposals for such a valve with a view to use in a dispenser with thick products and especially of the particular types referred to herein. Most desirably the fourth aspect is combined with any or all other aspects herein, but it is an independent proposal.

In this fourth aspect the invention provides a dispenser comprising a container for flowable product and a pump module mounted on the container at an opening thereof, the pump module comprising a pump body, which defines a pump chamber and a pump chamber inlet for product to flow from the container interior into the pump chamber through an inlet valve, and a pump actuator operable in a pumping stroke relative to the pump body to vary the volume of the pump chamber and dispense the product through a pump chamber outlet and a discharge channel of the pump module;

the pump chamber inlet defining a valve seat of the inlet valve, and the inlet valve comprising additionally a closure element movable up and down off the valve seat between closed and open positions and a retention structure which limits the rise of the closure element off the seat in the open position.

In a first subsidiary aspect a side edge of the closure element, around which product flows as it enters the pump chamber, is formed with a series of outwardly-projecting spaced bars or projections or other turbulence-inducing formations such as apertures to disrupt the product flowing around that edge. Desirably there are at least 10 of these. They may be evenly spaced around the edge of the closure element. They may project with free outer ends, not connected to one another. Their exact shape is not critical; they induce shear in the product flowing past and this can help it to flow.

In a second subsidiary aspect, which may be combined with the first, the retention structure comprises at least one bar extending transversely to the flow direction though the inlet, desirably parallel to the valve seat, preferably on the side upstream of the inlet valve. The bar may extend between spaced shank members extending through the inlet hole. It may constitute a claw of the retention structure. It may have a convergent edge facing upstream relative to the flow direction. This feature also may enhance shear of the product passing the valve. There may be two opposed retention claws, or three or more.

The closure element is desirably circular. Desirably it is a plate with a flat peripheral region, and the valve seat is also a flat region e.g. an inward flange of the pump body at the inlet opening. The closure element may have a central downward indentation to receive a front nose formation of a pump plunger to hold it down in the shut position.

(5) Plunger/Piston/Discharge Outlet Features

The above proposals are applicable in a range of pump types but as mentioned the preferred type has a plunger reciprocable relative to the pump body. The plunger usually has an exterior actuating head to be pressed by the user for dispensing and a stem connecting to a piston-cylinder mechanism in the pump for varying pump chamber volume, the plunger being reciprocable in the axial direction of the stem. The piston is on the plunger stem, the cylinder is comprised in the pump body, and the cylinder may be comprised in a movable pump body part in certain options described above.

In preferred embodiments the pump is of the "movable nozzle" type in which the discharge channel extends up through the plunger stem to a discharge opening usually at the plunger head, and usually through a projecting discharge nozzle. Effective priming usually requires an outlet valve function, conventionally provided by a ball valve in the discharge channel. However with thick products such outlet valves may not close reliably or may excessively resist flow. It is preferred to provide an additional or alternative outlet valve function by providing the piston slidably on the stem between upper and lower relative positions. The stem has one or more openings into the discharge channel from the pump chamber, closed by the piston in its lower relative position but open in the upper. As the plunger is depressed the piston slides naturally to the upper position under friction and pressure, opening flow from the pump chamber to discharge. As the plunger starts to rise again after the dispensing stroke (usually under restoring spring force) the piston slides naturally to the lower relative position under friction and shuts the stem openings, sealing the discharge channel so that negative relative pressure in the pump chamber refills it through the inlet valve. Preferably no additional outlet valve is used in the discharge channel, but this choice depends on the product.

In this version, we propose novel formations of the plunger stem adjacent the piston, particularly with a view to assisting flow of thick products which may be shear-thinning. Firstly, to enlarge opening area into the stem, plural said openings may be provided into the stem, preferably three, four or five. They may be divided from one another by internal partition walls in the stem, desirably radial and axial in plane. Desirably at least 80% or at least 90% of the stem's peripheral circumference is open at the level of the stem opening(s), i.e. any such walls are thin. Secondly, the stem may define an upwardly-curving floor surface at the underside of the or each inlet opening, to guide flow from a radially inward flow direction towards an upward (i.e. up inside the stem) direction. The first and second proposals are combinable.

A further option is to provide inwardly projecting vanes inside the discharge channel, to promote product shear and flow for thick products with corresponding properties.

A further proposal is a novel formation of the piston. This may apply with the slidable piston structure described above or with a fixed piston. The piston comprises an outwardly-directed peripheral seal portion slidingly engaging the cylinder wall and a front piston surface extending between the front of the peripheral seal portion and a generally central entrance/inlet to the plunger stem.

According to our new proposal the front piston surface converges progressively or gradually from the front of the peripheral seal portion to the central inlet. Preferably the angle of convergence increases progressively from the periphery. In radial cross-section the front piston surface may curve generally concavely from the periphery to the inlet. Preferably the front surface is inclined convergently, at 10 degrees or more to the axial direction, over at least 50%, preferably at least 60% or 70%, of its radial extent in from the periphery to the inlet. Preferably it is not inclined divergently at any part. Any or all of these features may be combined.

The effect is that the descending piston face picks up product from adjacent the cylinder wall and guides it smoothly towards the stem inlet. With thick products this can reduce pumping resistance compared with conventional stem pistons which are shaped primarily for displacement of free-flowing fluids and often have recessed or flat peripheral areas complementing the pump body base to maximise ultimate pump chamber clearance.

A further proposal for the plunger stem is that it comprises a downwardly-directed nose portion beneath the stem inlet (s) and this nose portion has a nose surface which diverges upwardly from a central protuberance. Desirably the divergence reduces progressively from the center towards the edge. This formation may promote shear and flow of product around the front of the stem and into the inlet(s) thereof.

The downwardly-directed nose portion of the plunger stem preferably fits a corresponding recess or indentation of a closure element of the inlet valve of the pump, to hold it shut when the plunger is fully depressed.

(6) Other Features

As explained the dispenser is typically of the airless type in which the container progressively reduces in volume as product as dispensed. This may be by a collapsible bag or liner of the container, but preferably is by a follower piston slidable up inside in a tubular (cylindrical) container and which defines the bottom of the product space therein. The follower piston desirably has a top surface shaped to complement the formation of the underside of the pump module, which may be any of a displacement body/disrupter formation/dividing screen as described above.

The pump preferably includes a return spring urging the plunger out to its extended position. However in exceptional cases the plunger or actuator may be moved manually back to the beginning of the dispensing stroke to assure re-filling of the pump chamber.

DESCRIPTION OF THE DRAWINGS

An embodiment of the invention and possible variants are now described by way of example, with reference to the accompanying drawings in which:

FIGS. 4(*a*) and 4(*b*) are respectively a top oblique view and a bottom oblique view of an outer fixed body part;

FIG. 5 is a top oblique view of a moveable body part including a pump cylinder;

FIG. 6 is a top oblique view of a disrupter/divider screen component, detached from the pump;

FIGS. 7(*a*) and 7(*b*) show a detail of the disrupter component of FIG. 6;

DESCRIPTION OF THE SELECTED EMBODIMENTS

Figure 1:
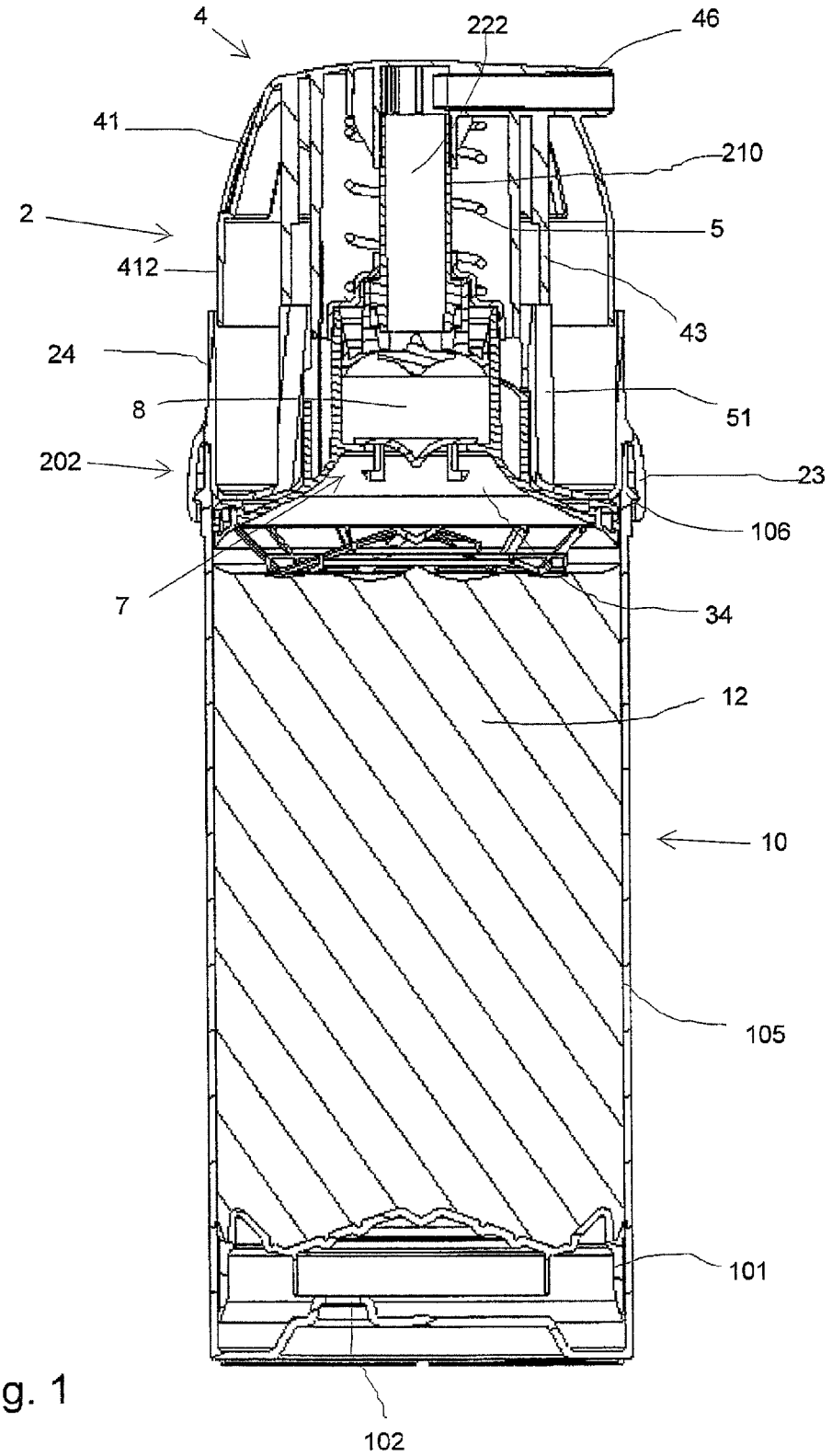
FIG. 1 is a vertical section through a pump dispenser.

For the purpose of promoting an understanding of the principles of the invention, reference will now be made to the embodiments illustrated in the drawings and specific language will be used to describe the same. It will nevertheless be understood that no limitation of the scope of the invention is thereby intended. Any alterations and further modifications in the described embodiments, and any further applications of the principles of the invention as described herein are contemplated as would normally occur to one skilled in the art to which the invention relates. One embodiment of the invention is shown in great detail, although it will be apparent to those skilled in the relevant art that some features that are not relevant to the present invention may not be shown for the sake of clarity.

FIG. 1. shows a container 10 with a cylindrical side wall 105, containing a product 12 which may be an ointment having pseudoplastic properties. The product space is bounded at the bottom by a follower piston 101 which slides up inside the container 10 as the remaining polymer product reduces; a vent opening 102 in the container bottom allows this.

At the top, the container 10 has a circular top edge with a snap rib 106 which may be conventional.

A pump unit or pump module 2 is connected here. The pump module has a fixed outer body part 202 having a peripheral engagement formation 23 that snap-engages the complementary formation 106 at the top of the container. Engagements other than snap engagements are possible, such as threads.

The outer or fixed body part 22 has an outer surround wall 24 projecting up cylindrically above the container wall 105, a generally cylindrical guide sleeve 25 projecting up concentrically in the centre, and open at the top and bottom ends, and a connecting floor 26 connecting between the securing formation 23 at the bottom edge of the guide sleeve 25; the floor 26 slopes gently upwards from the outside towards the centre. See also FIG. 4.

The pump module 2 also comprises a moveable pump body part which carries the entire pump engine of a piston-cylinder pump. This moveable body part 3—shown separately in FIG. 5—comprises a central cylinder 31 which constitutes the working cylinder of the pump, and has an inward flange 361 at the bottom defining an inlet opening 36. Spaced slightly radially out from the cylinder 31 is an intermediate sleeve 32 constituting a driven formation whose function is described later. The sleeve 32 includes an exposed edge with a pair of identical ramp surfaces 321 each extending in a generally helical path from a low point to a high point, and an opposed pair of driven ribs 33 projecting up axially inside the respective high points. The lower part of the moveable body 3 is constituted by a generally frusto-conical displacement web 34, inclining up from an outer peripheral annulus 35—which also functions as a seal holder—towards the inlet hole 36. The upwardly-convergent slope of the conical displacement web steepens slightly i.e. becomes less convergent as it approaches the center where it meets the inward flange 361 forming the inlet opening 36. This construction effectively closes off the interior of the container at the top, except for the inlet opening.

Figure 8:
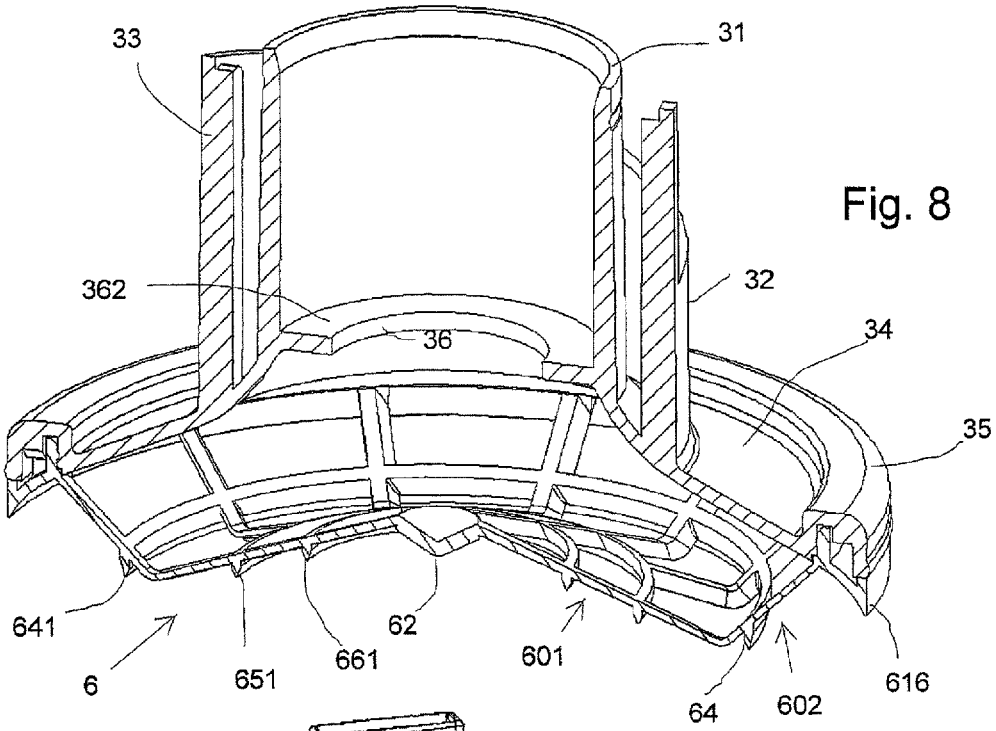
FIG. 8 is a sectional view of the moveable body component with the disrupter component attached.

Beneath the displacement web 34 a disrupter member 6 is clicked in place, by means of an upward annular skirt 614 around its peripheral annulus 621 which fits into a downward slot of the peripheral annulus 35 of the displacement web 34. Thus, the disrupter member also spans the entire interior of the container, and has a wiper seal portion 616 with a sharply-angled lower edge engaging against the container wall. The disrupter element 6 is a one-piece plastics molding having the general nature of a framework or grid of narrow bars intersecting to form multiple openings between, the bars being generally narrow and small compared with the size of the openings. In this embodiment there are 36 openings. The bars take the form of three intermediate rings 64,65,66 spaced generally evenly between the peripheral annulus 61 and the central hub 62, but with the next-outermost ring 64 being positioned axially lower than the others, and a plurality of generally radially-extending spoke members connecting between the concentric rings. In this embodiment there are six primary spokes 63 extending from the hub 62 to the periphery, and six subsidiary spokes 69 connecting only between the outer two rings and the periphery to sub-divide the larger outer openings. The axially lower position of the outer ring 64 creates a shape envelope with an annular leading edge bordered by an inclined inner region 601 and an oppositely-inclined outer region 602 (FIG. 8). This is to facilitate penetration into the surface of a product mass in the container. To improve product penetration further, the rings and spokes are formed with cutting edges. The cutting edges 641,651,661 on the rings are directed axially down toward the product mass. The cutting edges on the spokes by contrast are directed obliquely and all in the same circumferential direction: see FIGS. 6 and 7 (edge 631). This is to improve product penetration when the disrupter element 6 is rotating as discussed below.

The disrupter periphery 61 may carry keying projections 615 to constrain it to rotate with the moveable body portion 3. However this is optional. A frictional non-keyed engagement may suffice, and may indeed be better in allowing slip if high stress arises.

The actuating mechanisms are now described, first describing the elements of the plunger (indicated generally at 21 in FIG. 2) which is vertically reciprocable in the cylinder 31 under the influence of a restoring spring 5. The plunger comprises an actuator head 4 with an outwardly-extended casing shell terminating in a downward outer skirt 412 which just fits inside the outer surround 24 of the fixed body 202 in the pre-initiation position shown in FIGS. 1 and 2. In the pre-initiation position the plunger is at its highest extension relative to the fixed body 202. In the center the actuator head 4 has a downward socket 47 in which is fitted a tubular stem 210 defining an internal discharge channel 222. Inside the actuator head 4 the vertical discharge channel portion in the tubular stem 210 meets a radially-extending discharge channel portion extending out through a discharge nozzle 36 to a discharge opening. This structure is conventional as such and need not be further described. It should be noted that there is no valve body in the discharge channel, however. The spring 5 acts in compression between the underside of the actuator head and a spring seat component 50 clipped on top of the cylinder 31. A pump piston 216 is carried on the lower end of the tubular stem 210 and will be discussed later.

Figure 9:
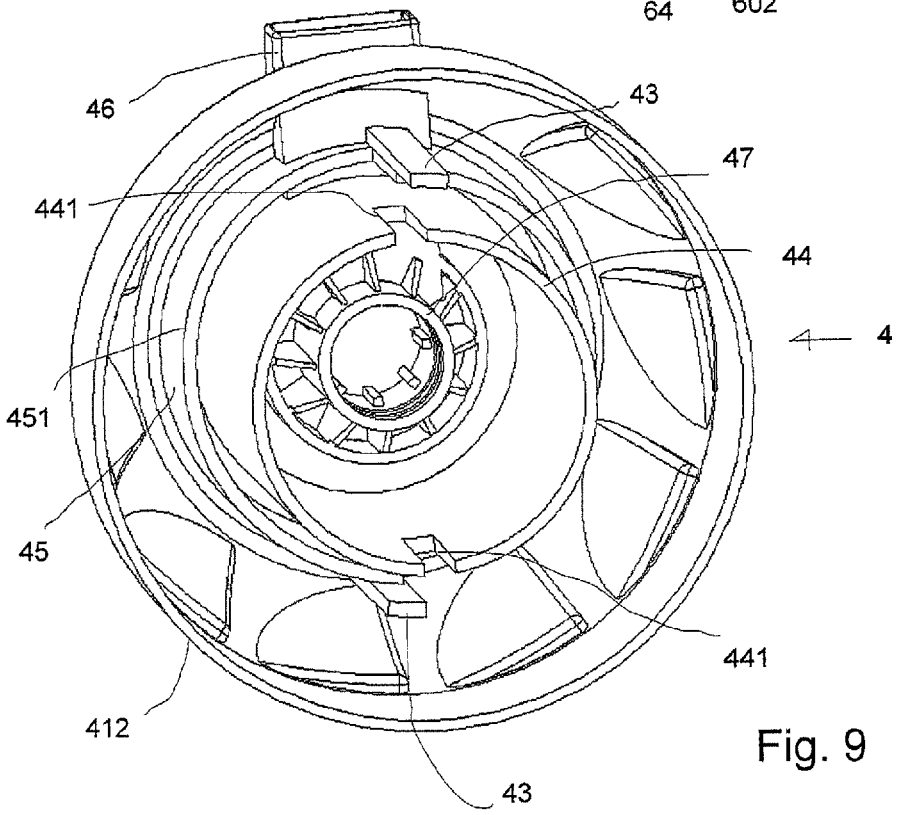
FIG. 9 is a view from the underside of a plunger head actuator component.

With reference also to FIG. 9, the underside of the actuator head features a pair of concentric downwardly-projecting skirts which are part of the actuating mechanism for the initiating of pump priming on the first use of the pump. An inner skirt 44 has a pair of opposed axially-extending drive slots 441 which are sized to receive the driven ribs 33 of the cylinder component mentioned above. This is so that turning the actuator turns the body portion 3. An outer drive skirt 45 has a pair of identical drive ramps 451 with generally helical form which interact with the external drive ramps 253 on the fixed body component: see FIG. 4(*a*). A pair of uplock projections 43 extends down from the underside of the actuator adjust outside the outer skirt 45 at opposed positions. These are to interact with the uplock ribs 251 of the fixed body member 202, mentioned previously (see FIG. 4(*a*)). The moveable body component 3 nests up with its intermediate sleeve 32 fitting up closely inside the central guide sleeve 25 of the fixed body portion 202, so that its ramped top edge surfaces 321 can oppose the correspondingly-ramped internal drive ramps 252 on the fixed body.

Figure 10:
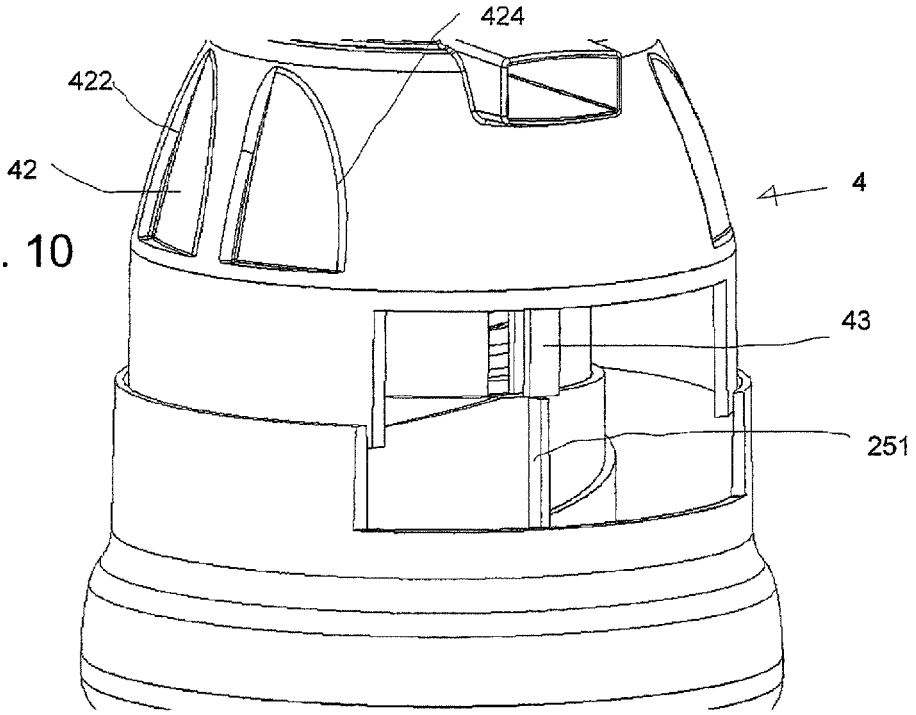
FIG. 10 is a fragmentary view of the pump with parts of the actuating head and outer body broken away to show a locked condition before initiation of priming.
Figure 11:
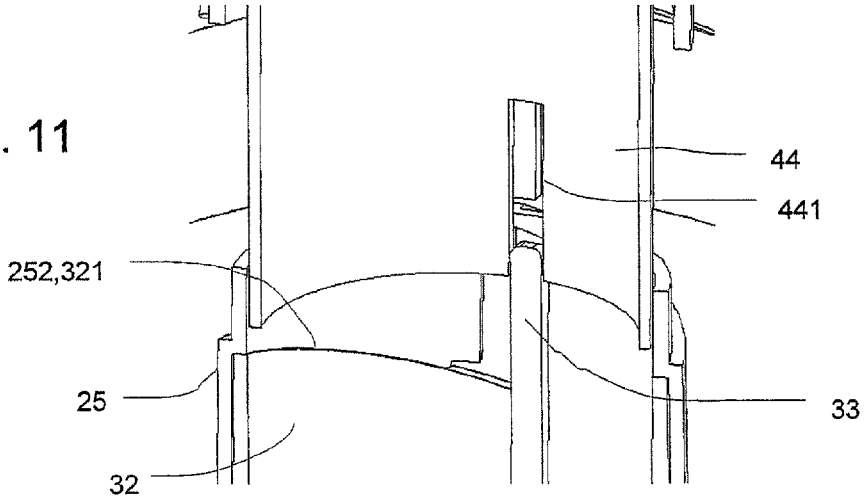
FIG. 11 is a fragmentary sectional view from the interior of the pump, with the components moved to a condition released for initiation.

With reference to FIG. 10, as supplied the moveable body component is pushed fully up inside the fixed body component. The actuator 4 is positioned initially so that its downwardly-projecting uplock ribs 43 lie over the corresponding uplock ribs 251 on the fixed body and prevent any depression of the plunger. On first use of the dispenser, initiation begins by rotating the plunger slightly—say through about 10 degrees—to bring the uplock ribs 43,251 out of alignment so that the plunger can descend. In this situation (see the internal view of FIG. 11) the drive slots 441 of the actuator skirt 44 engage the tops of the driven ribs 33 on the intermediate skirt 32 of the moveable body part 3. These parts must now turn together. The user turns the actuator clockwise, assisted by the shaped indentations 42 in its surface which have steep abutments on the clockwise-facing side and shallow abutments on the other side. The engagement between the ramps 252,321 of the fixed component sleeve 25 and mobile component sleeve 32 causes the mobile component to be driven downwards as it turns. At the same time, the downwardly-directed ramps 451 of the outer actuator skirt 45 come into opposition with the corresponding external ramps 253 on the fixed body portion so that the moveable body is constrained to advance and rotate. As a result the entire pump engine, carrying the conical displacement web 34 and the disrupter component 6 before it, moves forward (while rotating) towards the surface of the product 12 in the container. At the same time the actuator 4 pushes the piston 216 to the bottom of its stroke in the cylinder 31, reaching the relative positions shown in FIG. 12 with the displacement web or displacement body 34 now substantially moved below the fixed body 32 and the actuator casing substantially recessed into the outer surround 24 of the fixed body.

Figure 13:
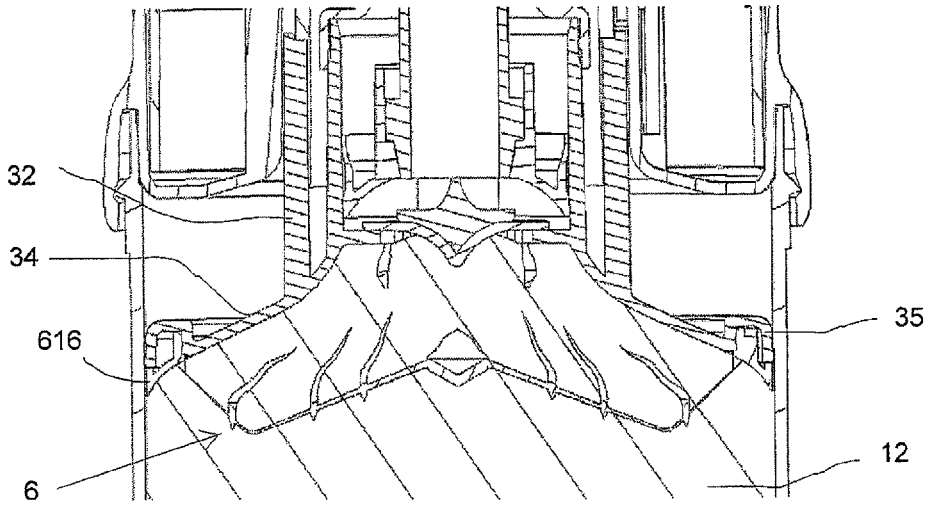
FIG. 13 is a fragmentary vertical section showing the corresponding situation when the pump's features are used to initiate priming in a container of product, having started from the FIG. 2 situation.

By this action, as indicated in FIG. 13, the cutting edges and leading portions of the disrupter component 6 readily enter into and disrupt the upper portion of the product mass (which may have hardened or skinned over, and otherwise be very difficult to urge into the pump chamber for priming). At the same time the descent of the displacement web 34 brings it into contact with the disrupted product, outer edge first. Its convergent shape, with the steeply inclined peripheral portion of the outer disrupter annulus 616 leading, squeezes the product up and in towards the inlet opening, passing through the openings of the disrupter component as it goes. FIG. 13 illustrates corresponding regions of disruption, where shearing of the product past its yield stress causes it to flow much more readily.

Figure 2:
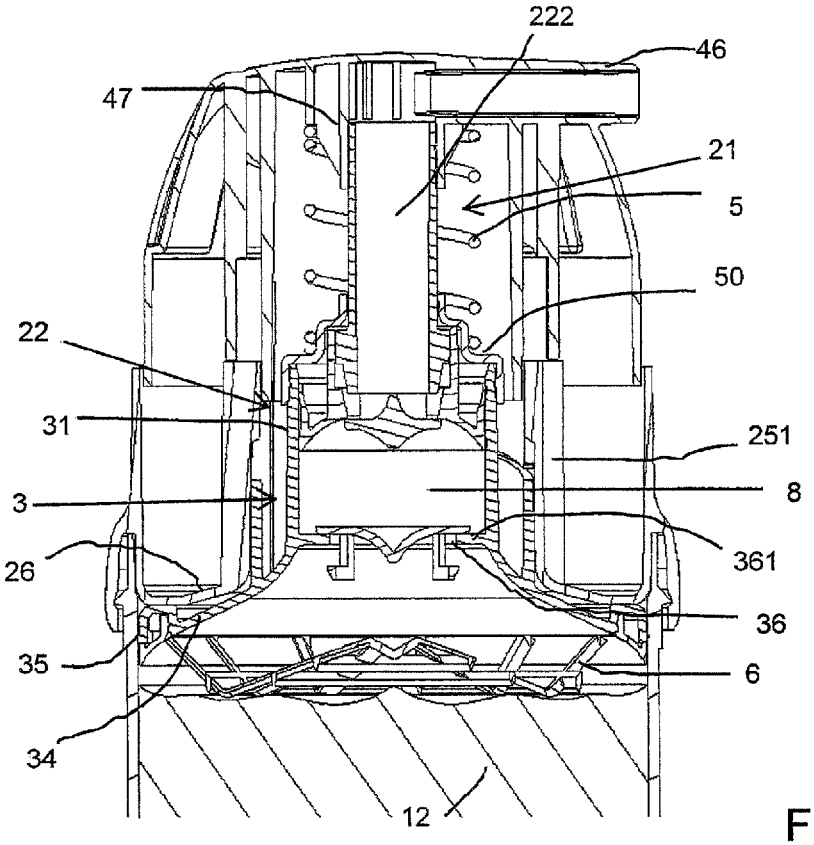
FIG. 2 shows the pump module somewhat larger.
Figure 3:
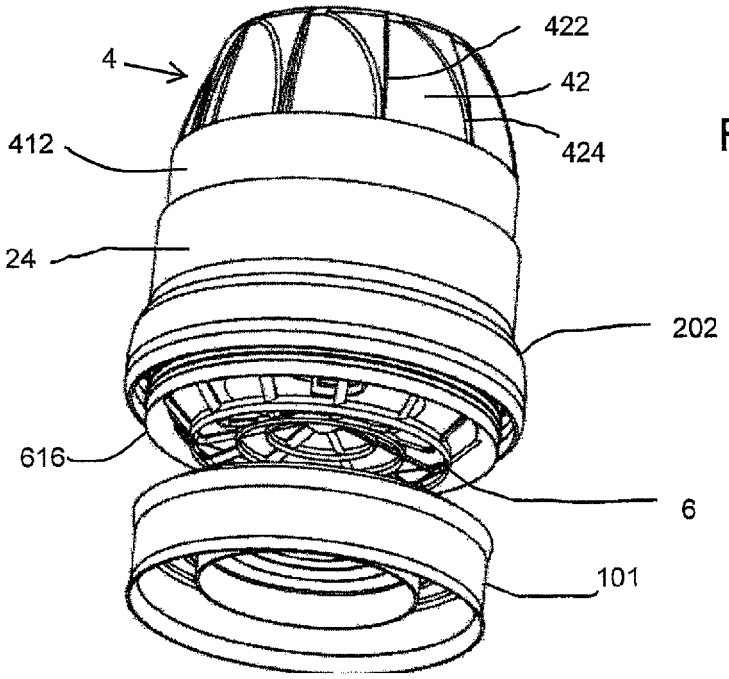
FIG. 3 is an external view of the pump module and follower piston separated from the dispenser.
Figure 14:
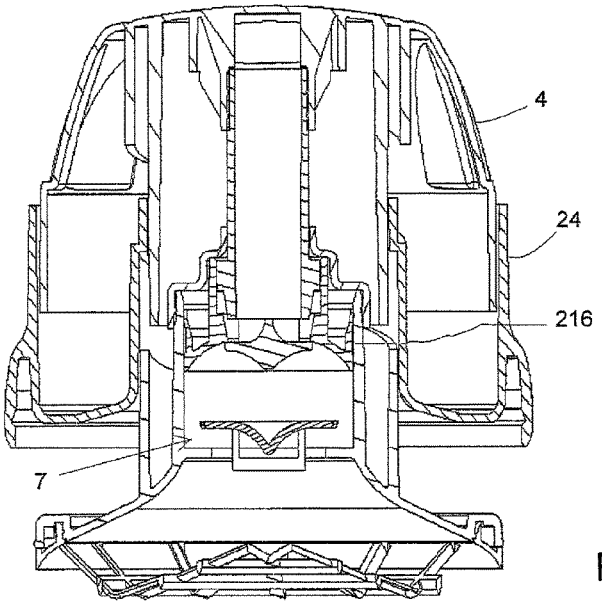
FIG. 14 is a cross-section corresponding to FIG. 12 with the pump plunger extended again to its upward position, showing the previously mobile displacement and disruption components remaining extended downwardly.

Subsequent release of the pressure of the plunger allows the actuator head to rise under the action of the restoring spring (not shown in FIGS. 12 and 14) to the normal operating position seen in FIG. 14: here the bodily downward shift of the moveable body portion, carrying the pump engine with it, leads to the actuator head 4 being recessed substantially further than before into the fixed body surround as can be seen by comparison of FIG. 14 with FIG. 2. This remains the rest condition of the dispenser for future use. The disrupter element 6 remains immersed in the product upstream of the inlet opening 36, and helps it to flow each time the pump chamber 8 must refill.

The top form of the follower piston 101 conforms to the bottom shape envelope of the disrupter element 6, so that as much product as possible can be expelled from the container (although the follower piston cannot rise right to the top).

Figure 15:
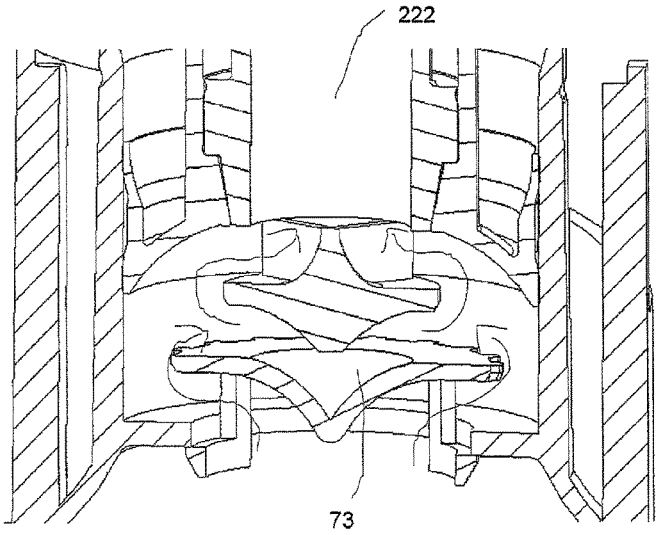
FIG. 15 is a fragmentary vertical cross section showing, for illustration only, both inlet valve and plunger stem seal in opening conditions to illustrate flow paths around each of them.
Figure 18:
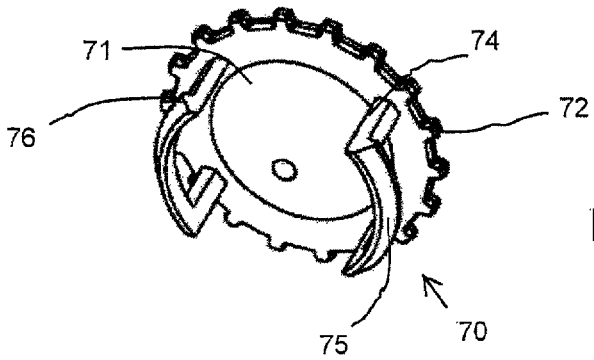
FIG. 18 is a lower oblique view of the inlet valve closure element.

Special conformations of the pumping elements are now described. Firstly, with reference to FIGS. 14, 15 and 18 the inlet valve 7 has a closure member 70 which is not spring biased, but comprises a disk with a generally flat plate periphery 71 with a radially-outwardly projecting array of square-formed projections or castellations 74 around its edge as seen in FIG. 18. In this embodiment there are eighteen of these. They are slightly narrower than the spacing between them. They function to promote shear and flow of the product as it flows up around the valve, as indicated schematically by arrows in FIG. 15. The closure element is retained in the inlet hole by a pair of retention claws 76, forced down through the hole on assembly, each comprising a pair of spaced shank members 74 connected at their bottom ends by an arcuate bar 75 formed outwardly into the claw form 76 to prevent escape of the closure from the inlet hole. The centre of the valve disk has an indentation 73 (see FIG. 15) which complements a projecting nose on the plunger stem above. The form of the shank 74 and transverse bar 75 also helps to promote shear of the product passing through the inlet.

Figure 16A:
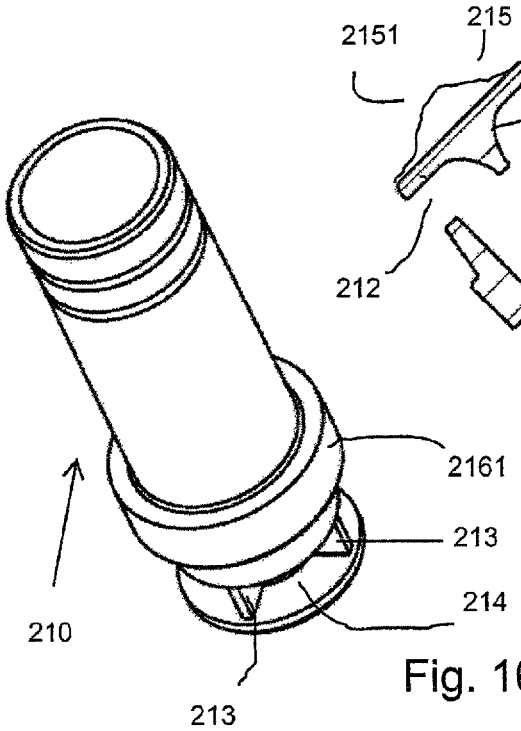
FIGS. 16(*a*) and 16(*b*) are respectively a top oblique view and an axial section through a plunger stem component.
Figure 16B:
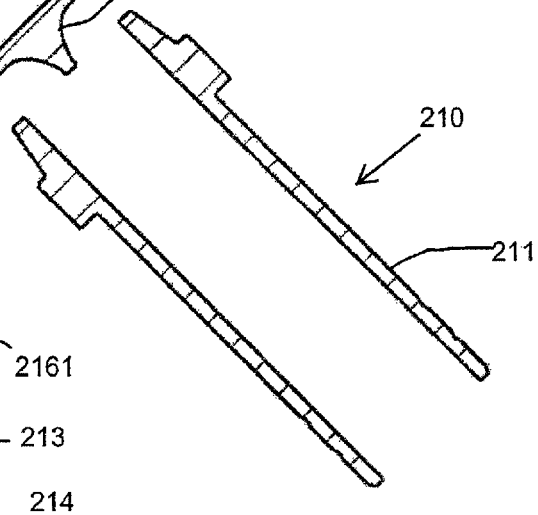

The plunger stem, shown in more detail in FIG. 16, has a main tube 211 with four entry openings 214 at the bottom. In conventional pumps the entry openings are formed as simple holes through the tube wall. In this design the plunger stem is molded with internal partition walls 213 in a cross or star form, and the tube wall is not present between the openings 212 so that they occupy nearly all of the circumferential extent of the stem. Additionally, as best seen in FIGS. 2 and 16(*b*), the end piece of the stem forms a curved floor for each entry channel, making a smooth transition from the radially-inward flow in through the openings 212 to axial flow up the discharge channel 222 inside the stem 210. This reduces flow resistance at this point. The front end of the stem is formed of a projecting nose formation with a central protuberance 2151 and a concave-section arcuate part around it, which fits into the depression 73 at the top of the valve 7. As again shown schematically in FIG. 15 by arrows, these curved surfaces promote high-shear flow of the product around the end of the plunger stem and into the openings 212.

Figure 12:
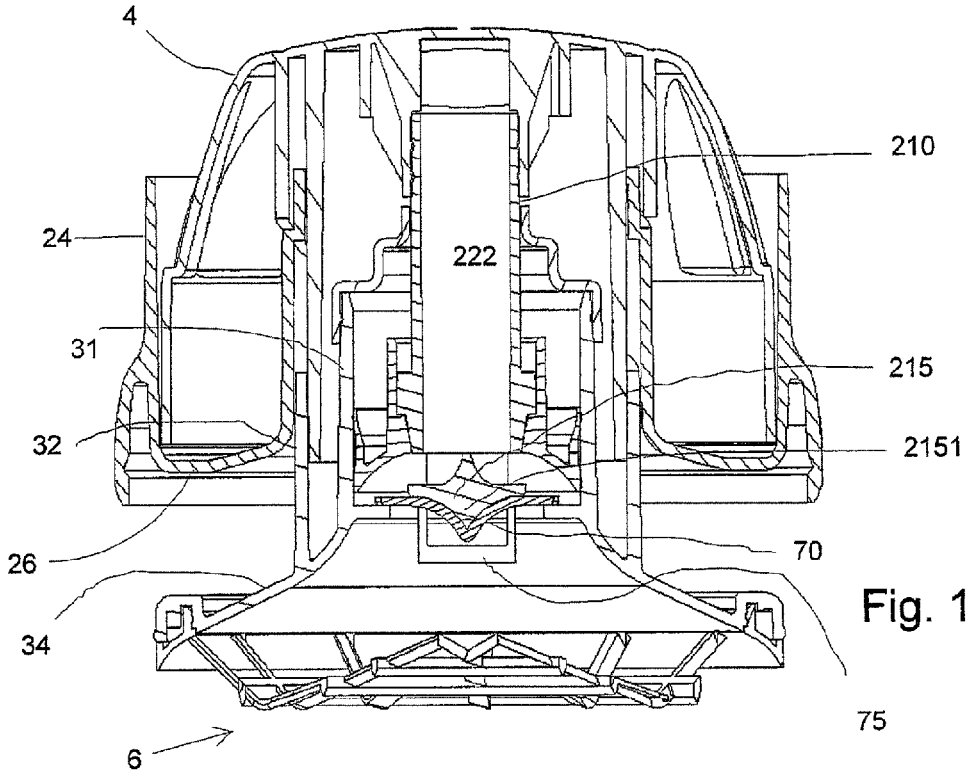
FIG. 12 is a vertical section through the complete pump, but separate from the container, showing the positions of the components as after initiation, with the pump plunger fully depressed.
Figure 17A:
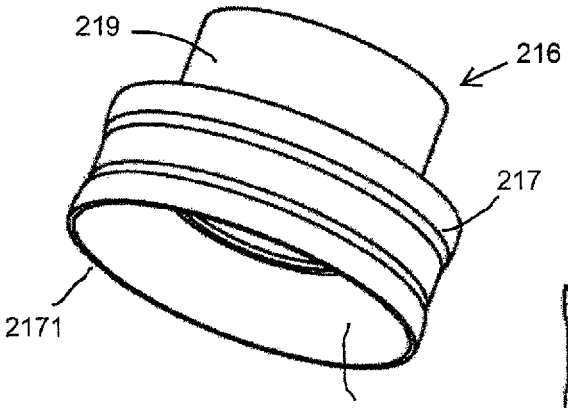
FIGS. 17(*a*) and 17(*b*) are respectively a lower oblique view and an axial cross-section through a sliding piston.
Figure 17B:
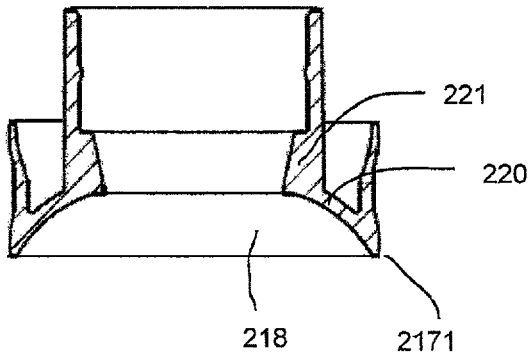

In a manner which is in itself known, the piston 216 (see FIG. 17) is mounted axially slidably on the end of the plunger stem 210, having a mounting sleeve 219 fitting over the stem end and limited in travel by a stop ring 2161 on the stem. The piston has a corresponding stop ring 221. From the sleeve 219 an outward skirt 220 extends to a peripheral seal 217 of the piston, the seal having a leading edge 2171. A front surface 218 of the piston between this leading edge 2171 and the centre has a concave cross section, converging progressively and at an increasing angle from the periphery towards the centre. The closed position of the piston is seen in FIGS. 2 and 14: with the piston rising or at its top position the spring pulls the stem up through it so that it covers the stem openings and flow out of the pump chamber is prevented. When the plunger is being depressed or is at its bottom position, as seen in FIG. 12, the piston lags behind and its curved front surface 218 aligns exactly with the top edge of the entry openings 212 into the stem 210, reducing flow resistance.

While the invention has been illustrated and described in detail in the drawings and foregoing description, the same is to be considered as illustrative and not restrictive in character, it being understood that only the preferred embodiment has been shown and described and that all changes, equivalents, and modifications that come within the spirit of the inventions defined by following claims and disclosed herein as general teachings are desired to be protected. All publications, patents, and patent applications cited in this specification are herein incorporated by reference as if each individual publication, patent, or patent application were specifically and individually indicated to be incorporated by reference and set forth in its entirety herein.

We claim:

1. A dispenser comprising:

a container for flowable product; and a pump module mounted on the container at an opening thereof, the pump module comprising:

a pump body, which defines a pump chamber and a pump chamber inlet for the flowable product to flow from a container interior into the pump chamber, and a pump actuator operable in a pumping stroke relative to the pump body to vary the volume of the pump chamber and dispense the flowable product through a pump chamber outlet and a discharge channel of the pump module, wherein the pump body comprises a movable portion which is operable in a displacement stroke into the container, the movable portion comprising a displacement body having a product-engaging face directed onto an interior product space of the container upstream of the pump chamber inlet; and wherein the displacement body comprises a disrupter formation projecting in front of the product-engaging face having a plurality of bars with multiple flow openings between them for product flow.

2. The dispenser of claim 1 wherein the pump body comprises a fixed body portion which is fixed to the container around an opening edge thereof, and the movable portion is operable in the displacement stroke into the container relative to the fixed body portion.

3. The dispenser of claim 1 wherein the displacement body has a peripheral seal which makes a sealing contact against a container wall.

4. The dispenser of claim 1 wherein the product-engaging face of the displacement body is sloped in the direction towards the pump from the periphery to the inlet.

5. The dispenser of claim 4 wherein the inlet is central and the product-engaging face of the displacement body has a frusto-conical form.

6. The dispenser of claim 4 wherein said slope has a peripheral steeper region adjacent a container wall and/or a central steeper region adjacent the inlet.

7. The dispenser of claim 1 comprising a displacement actuating mechanism for controllably driving the movable portion in the displacement stroke, the actuating mechanism comprising an exterior actuator to be driven by manual force.

8. The dispenser of claim 7 wherein the actuating mechanism is operable to move the movable portion with a combination of advancement into the container and rotation around the axis of advancement.

9. The dispenser of claim 7 wherein the pump actuator of the dispenser is a plunger reciprocable relative to the pump body and having an exterior actuating head and a stem, the plunger constituting said actuator for the displacement actuating mechanism.

10. The dispenser of claim 9 wherein the plunger comprises a drive engagement formation which engages a corresponding driven engagement formation of the movable body.

11. The dispenser of claim 7 wherein the actuating mechanism comprises a guide track formation on one of the displacement actuator, a driven engagement formation and a fixed body part, and said guide track formation engages a corresponding follower formation on another of said actuator, formation and body part, whereby an axial push on the displacement actuator is converted to a rotation of the displacement body.

12. The dispenser of claim 11 wherein the guide track is helical.

13. A dispenser comprising:

a container for flowable product; and a pump module mounted on a container at an opening thereof, the pump module comprising a pump body, which defines a pump chamber and a pump chamber inlet for the flowable product to flow from the container interior into the pump chamber, and a pump actuator operable in a pumping stroke relative to the pump body to vary the volume of the pump chamber and dispense the flowable product through a pump chamber outlet and a discharge channel of the pump module, wherein the pump body comprises a dividing screen structure, upstream of the pump chamber inlet and separating the pump chamber inlet from at least most of the container interior, the dividing screen structure comprising a plurality of dividing bars defining multiple flow openings through which the flowable product passes on the way to the pump chamber inlet from the container interior.

14. The dispenser of claim 13 wherein the dividing screen structure defines at least 20 flow openings.

15. The dispenser of claim 13 wherein the dividing screen structure is a one-piece unit attached to an underside of the pump body.

16. The dispenser of claim 13 wherein the dividing bars have cutting edges directed away from the pump.

17. A dispenser comprising:

a container for flowable product; and a pump module mounted on a container at an opening thereof, the pump module comprising a pump body, which defines a pump chamber and a pump chamber inlet for the flowable product to flow from the container interior into the pump chamber, and a pump actuator operable in a pumping stroke relative to the pump body to vary the volume of the pump chamber and dispense the flowable product through a pump chamber outlet and a discharge channel of the pump module, wherein the pump body comprises a product-engagement portion directed onto an interior product space of the container, upstream of the pump chamber inlet, and a disrupter formation which projects in front of the product-engaging portion into the interior product space, the disrupter formation comprising an array of disrupter elements with spacing between; and wherein the disrupter formation comprises a set of circumferentially-distributed radially-extending bars connecting between concentric annular bars, with at least one of the radially-extending bars having cutting edges directed with a circumferential component and with multiple openings provided between the radially-extending and the annular bars.

18. The dispenser of claim 17 wherein the pump body has a fixed body portion fixed to the container, the disrupter formation is mounted movably relative to the fixed body portion, and the dispenser comprises an actuating mechanism operable to move the disrupter formation relative to the fixed body portion.

19. The dispenser of claim 18 wherein the actuating mechanism is operable to move the disrupter formation with a combination of advancement into the container and rotation around the axis of advancement.

20. The dispenser of claim 18 wherein the pump actuator of the dispenser is a plunger reciprocable relative to the pump body and having an exterior actuating head and a stem, the plunger constituting an actuator for the displacement actuating mechanism.

21. The dispenser of claim 17 wherein the disrupter formation projects in front of a product-engaging face of the pump body, and wherein the disrupter elements comprise a plurality of bars defining multiple flow openings between them.

22. The dispenser of claim 17 wherein the disrupter formation spans the container interior.

* * * * *